US005538445A

United States Patent [19]

Grzybowski et al.

[11] Patent Number: 5,538,445

[45] Date of Patent: Jul. 23, 1996

[54] ELECTRICAL CONNECTOR HAVING AN IMPROVED TERMINAL RETENTION MEANS

[75] Inventors: Richard W. Grzybowski, Lebanon; John M. Myer, Millersville; Keith R. Denlinger, Lancaster, all of Pa.; Richard E. Hasz, Ramseur, N.C.

[73] Assignee: The Whitaker Corporation, Wilmington, Del.

[21] Appl. No.: 460,299

[22] Filed: Jun. 2, 1995

Related U.S. Application Data

[63] Continuation of Ser. No. 164,164, Dec. 7, 1993, abandoned.

[51] Int. Cl.[6] ..... H01R 13/514

[52] U.S. Cl. ..... 439/752; 439/744

[58] Field of Search ..... 439/744, 745, 439/750, 752

[56] References Cited

U.S. PATENT DOCUMENTS

| | | | |
|---|---|---|---|
| 2,825,037 | 2/1958 | French . | |
| 2,942,229 | 6/1960 | Berger . | |
| 3,149,897 | 9/1964 | Martineck . | |
| 3,803,533 | 4/1974 | Taplin . | |
| 3,993,390 | 11/1976 | Eigenbrode . | |
| 4,057,879 | 11/1977 | Eigenbrode | 24/230 |
| 4,145,103 | 3/1979 | Knowles . | |
| 4,147,400 | 4/1979 | Snyder et al. | 439/744 |
| 4,188,083 | 2/1980 | Knowles . | |
| 4,245,879 | 1/1981 | Buck . | |
| 4,296,989 | 10/1981 | Larson et al. . | |
| 4,579,411 | 4/1986 | Cobaugh et al. . | |
| 4,621,885 | 11/1986 | Szczesny . | |
| 4,669,801 | 6/1987 | Worth | 439/404 |
| 4,693,533 | 9/1987 | Szczesny | 439/350 |
| 4,697,832 | 10/1987 | Dickirson | 285/319 |
| 4,726,783 | 2/1988 | Nakazawa et al. | 439/350 |
| 4,762,505 | 8/1988 | Asick et al. | 439/347 |
| 4,973,268 | 11/1990 | Smith et al. | 439/595 |
| 4,979,915 | 12/1990 | Pitts | 439/884 |
| 4,984,998 | 1/1991 | Duncan et al. | 439/352 |
| 4,986,765 | 1/1991 | Korsunsky et al. | 439/326 |
| 4,995,825 | 2/1991 | Korsunsky et al. | 439/328 |
| 5,004,429 | 4/1991 | Yagi et al. | 439/296 |
| 5,100,346 | 3/1992 | McCardell | 439/595 |
| 5,108,318 | 4/1992 | Sakurai et al. | 439/744 |
| 5,139,447 | 8/1992 | Yoneda et al. | 439/752 |
| 5,151,052 | 9/1992 | McCardell | 439/598 |
| 5,181,862 | 1/1993 | Hawk et al. | 439/595 |
| 5,183,418 | 2/1993 | Yamanashi et al. | 439/752 |
| 5,186,657 | 2/1993 | Abe | 439/595 |
| 5,186,662 | 2/1993 | Yuasa et al. | 439/752 |
| 5,187,862 | 2/1993 | Ohsumi | 29/764 |

*Primary Examiner*—David L. Pirlot
*Assistant Examiner*—Daniel Wittels
*Attorney, Agent, or Firm*—Timothy J. Aberle

[57] ABSTRACT

An electrical connector (10) has a housing (14) with at least one terminal receiving cavity (24) provided therein. A terminal (18) is positioned in the terminal receiving cavity (24) and at least one terminal retention member (16) is secured in the terminal receiving cavity (24). The terminal retention member (16) is a separate resilient member which is not integrally molded with the housing (14). A rib (68) may be provided in the terminal receiving cavity (24) to cooperate with the terminal retention member (16) to prevent the overstress of the terminal retention member (16).

16 Claims, 4 Drawing Sheets

ELECTRICAL CONNECTOR HAVING AN IMPROVED TERMINAL RETENTION MEANS

This application is a Continuation of application Ser. No. 08/164,164 filed Dec. 7, 1993, now abandoned.

FIELD OF THE INVENTION

The invention relates to electrical connectors of the type having a plurality of terminal receiving openings into which a similar plurality of terminals are inserted. In particular, the invention is directed to an improved locking means to hold the terminals in the terminal receiving openings.

BACKGROUND OF THE INVENTION

Many connectors are available on the market today which incorporate a terminal retention feature to adequately hold the terminal in the terminal receiving openings. These retention features are particularly necessary when the connector is to be used in environments in which vibration and like will occur.

An example of the type of connector described above is shown in U.S. patent application Ser. No. 07/500,982 filed Mar. 28, 1990. The connector disclosed has a housing assembly which is intended to receive at least one terminal therein. The housing assembly has a housing body with a terminal locking member. A terminal position assurance member is also provided. The housing body has a mating face and a rear terminal receiving face which is directed oppositely with respect to the mating face. A terminal receiving passage way extends through the housing body from the rear face towards the mating face and the terminal locking member is insertable into the housing body from the mating face. The housing assembly is characterized in that the passage way has internal wall portions which have a fixed shoulder thereon which is directed towards the mating face. A cantilever beam is provided in the passage way, the beam has a fixed shoulder. The beam has a moveable shoulder thereon adjacent to its free end which is directed towards the mating face. The beam is flexible laterally of its length away from the fixed shoulder. The terminal locking member has a beam engaging portion which is positioned adjacent to the free end of the beam when the locking member is inserted into the body portion. The locking member is insertable only when the beam is in its unflexed position. A terminal with retaining portions thereon is inserted into the passageway from the rear face until the retaining portions are beyond the shoulders. The cantilever beam is temporarily flexed during movement of the terminal past the shoulders. After insertion of the terminal, the locking member can be inserted into the mating face. The fixed shoulder is preferably on an ear which in integral with, and extends from, the internal wall portions of the passage way. The beam engaging portion of the locking member is moveable against the beam when the beam is in its flexed condition. This configuration ensures that the locking member can be inserted into the housing body only if the terminal is fully inserted. The locking member cannot be inserted into the housing body if the terminal is only partially inserted. The beam engaging portion is positioned beside, or adjacent to, the cantilever beam after insertion and serves to prevent flexure of the beam when the locking member is inserted. The terminal is now locked in the housing assembly.

These prior art connectors are adequate in applications in which the terminal receiving cavities are spaced sufficiently apart. However, in instances in which the space is at a premium and centerline spacing it to be minimized these prior art connectors are inadequate.

It would therefore be beneficial to provide a retention member which utilizes less space. This would allow the terminal receiving cavities to be positioned on closer center line spacing, which in turn allows the terminals to be spaced closer together. This is an important advantage particularly as connectors are required to facilitate higher density applications.

It would also be beneficial to provide a separate terminal retention member, allowing the terminal retention member to be removed and replaced if damage occurs. In prior connectors, in which the terminal retention members were integrally molded with the housing, the entire connector would have to be replaced if a single terminal retention member were damaged.

SUMMARY OF THE INVENTION

The invention is directed to an electrical connector which has a housing with at least one terminal receiving cavity provided therein. A terminal is positioned in the terminal receiving cavity and at least one terminal retention member is secured in the terminal receiving cavity. The terminal retention member is a separate resilient member which is not integrally molded with the housing.

In a particular embodiment the terminal retention member is a separate member which is stamped and formed from metal and is not integrally molded with the housing.

The invention is also directed to an electrical connector which has a housing with a terminal receiving cavity which has a rib provided therein. The terminal retention member is secured in the terminal receiving cavity proximate the rib, and is a separate resilient member which is not integrally molded with the housing. A terminal locking section of the terminal retention member is positioned proximate the rib such that the rib cooperates with the terminal retention member to prevent the overstress of the terminal retention member.

DETAILED DESCRIPTION OF THE INVENTION

Figure 1:
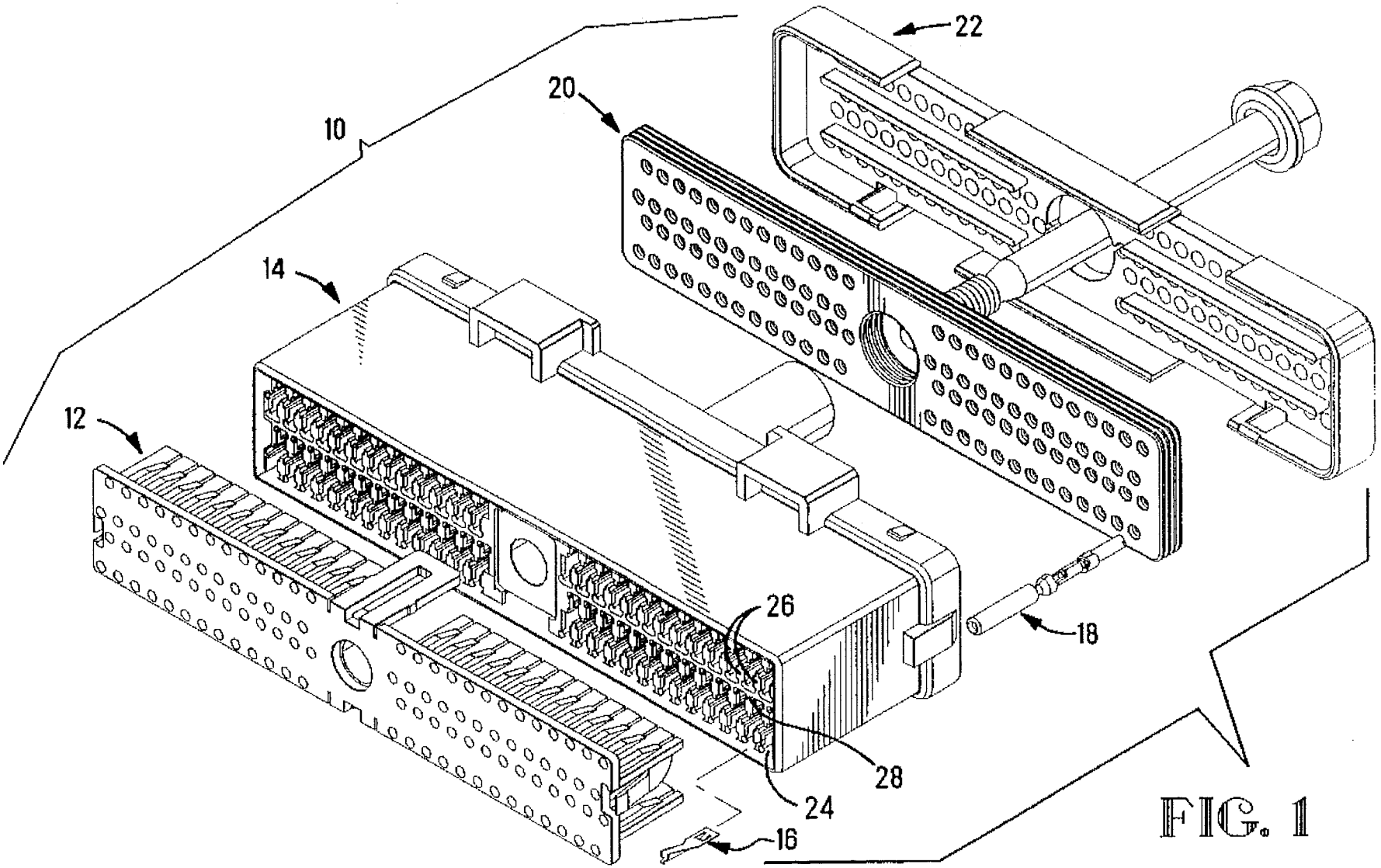
FIG. 1 is a perspective, exploded view of a connector showing a terminal retention member prior to insertion into the connector housing.

Connector 10, as shown in FIG. 1, includes terminal position assurance member 12, housing 14, terminal retention member 16, terminals 18, seal 20 and rear face plate 22. The invention described herein is directed to the terminal retention member 16. Therefore, various aspects of the connector 10 will not be discussed in detail. For a more complete explanation of these aspects, refer to U.S. Pat. No. 5,071,369 which is hereby incorporated by reference.

Housing 14 is provided with four rows of terminal receiving cavities 24 which are defined by partitions 26. The cavities 24 in each set of two rows face each other and are offset latterly so that the partitions 26 in one row are on the same center line as the facing cavities 24. A thin wall 28 separates the two sets of rows.

Figure 2:
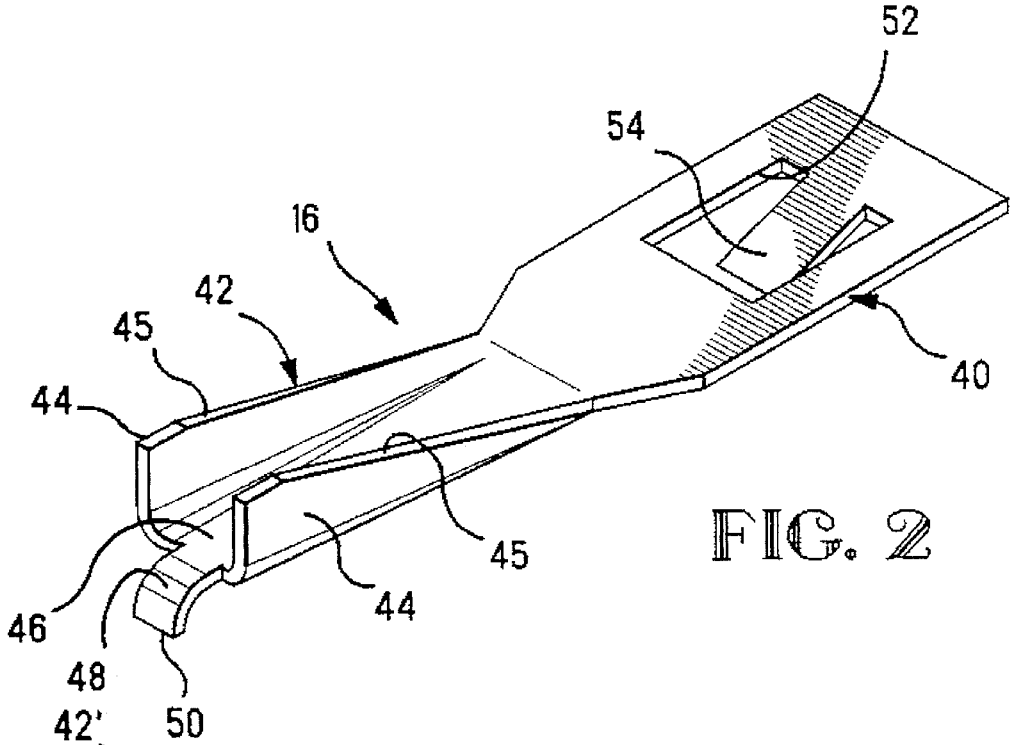
FIG. 2 is an enlarged perspective view of the terminal retention member.

Each terminal receiving cavity 24 is dimensioned to receive a terminal retention member therein. The terminal retention member 16, as best shown in FIG. 2, is a separate resilient member made from material which exhibits the appropriate strength and resiliency characteristics. In the embodiment shown, the terminal retention member is metal. The metal is stamped and formed to the particular configuration shown, however other shapes and configurations of the terminal retention member are possible.

The configuration of the terminal retention member 16 shown in FIG. 2 has a mounting section 40 and a terminal locking section 42 projecting therefrom. The terminal locking section 42 is formed in a generally U-shaped configuration having a base 46 and walls 44 projecting from either side thereof. The walls 44 are generally parallel to each other and are perpendicular to base 46. Lead-in surfaces 45 are provided on either wall 44. Projecting from base 46 in a direction essentially opposite from mounting section 40 is overstress tab 48. The overstress tab 48 has a arcuate configuration, with a free end 50 thereof projecting below base 46.

The mounting section 40 has an opening 52 provided therein. A locking tab 54 extends into opening 52 from mounting section 40. The locking tab is bent downward to extend beyond the plane of base 46 in essentially the same direction as the free end 50 of tab 48.

The terminal retention member 16 is inserted into the housing 14 through a front face as shown in FIG. 1. The terminal retention members 16 can be mass inserted into the terminal receiving cavities 24 or the members can be inserted individually as required.

As the terminal retention members are inserted into the terminal receiving cavities 24 each mounting section 40 is moved into cooperation with slots 62 and recess 60 of the terminal receiving cavities. As insertion continues, the locking tab 54 is resiliently deformed until the locking tab is moved beyond shoulder 66. As this occurs, the locking tab is allowed to return to the unstressed position as it enters recess 60. Almost simultaneously with the locking tab moving to the unstressed position, an edge of the mounting section 40 engages shoulder 64 of the terminal receiving opening 24.

In this position, the locking tab 54 cooperates with shoulder 66 to prevent the terminal retention member 16 from being removed through the front of the housing. The shoulder 64 of the housing cooperates with the mounting section 40 to prevent the terminal retention member 16 from being removed through the rear of the housing. The terminal retention member 16 is now locked in position.

It is worth noting that if the terminal retention member 16 is required to be removed a tool can be inserted through the rear of the housing in recess 60 to resiliently deform the locking tab upward, thereby allowing the removal of the terminal retention member through the front of the housing.

The use of a metal terminal retention member has several benefits. First the use of metal enables the retention member to utilize less space. This allows the terminal receiving cavities to be positioned on closer center line spacing, which in turn allows the terminals to be spaced closer together. This is an important advantage particularly-as connectors are required to facilitate higher density applications.

The use of a separate terminal retention member also allows the terminal retention member to be removed and replaced if damage occurs. In prior connectors, in which the terminal retention members were integrally molded with the housing, the entire connector would have to be replaced if a single terminal retention member were damaged. In prior art connectors the entire housing would be made from the same material as the terminal retention member. Consequently, as the material had to have the required resilient characteristics, the cost of the housing would be higher if the housing could be made from less expensive material.

Figure 7:
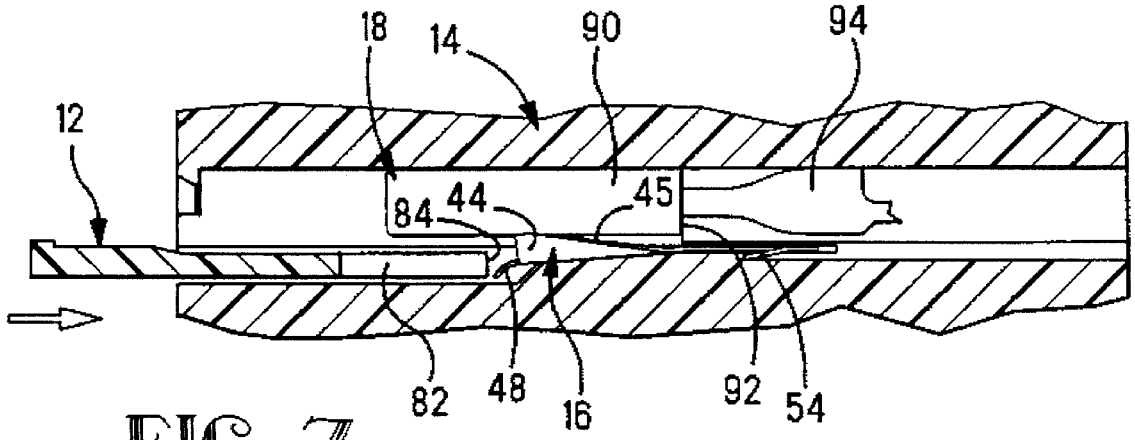
FIG. 7 is a cross-sectional view, similar to that shown in FIG. 6, of the terminal receiving cavity with a terminal more fully inserted therein causing the terminal retention member to deflect.

With the terminal retention members 16 secured in position, terminals 18 are inserted into the terminal receiving cavities 24. Referring to FIG. 7, as each terminal 18 is inserted into the respective terminal receiving cavity 24, a contact portion 90 of the terminal 18 engages the lead-in surfaces 45 of walls 44 of the terminal retention member 16. As the insertion of the terminal continues, the terminal retention member 16 is cammed downward to the stressed position shown in FIG. 7. The dimensioning of the walls 44 allow the terminal to be inserted past the terminal locking section 42. The terminal locking section 42 is prevented from taking a permanent set as the terminal is inserted due to the fact that the base 46 engages rib 68 to ensure that the terminal locking section is not moved beyond its elastic limit.

Figure 4:
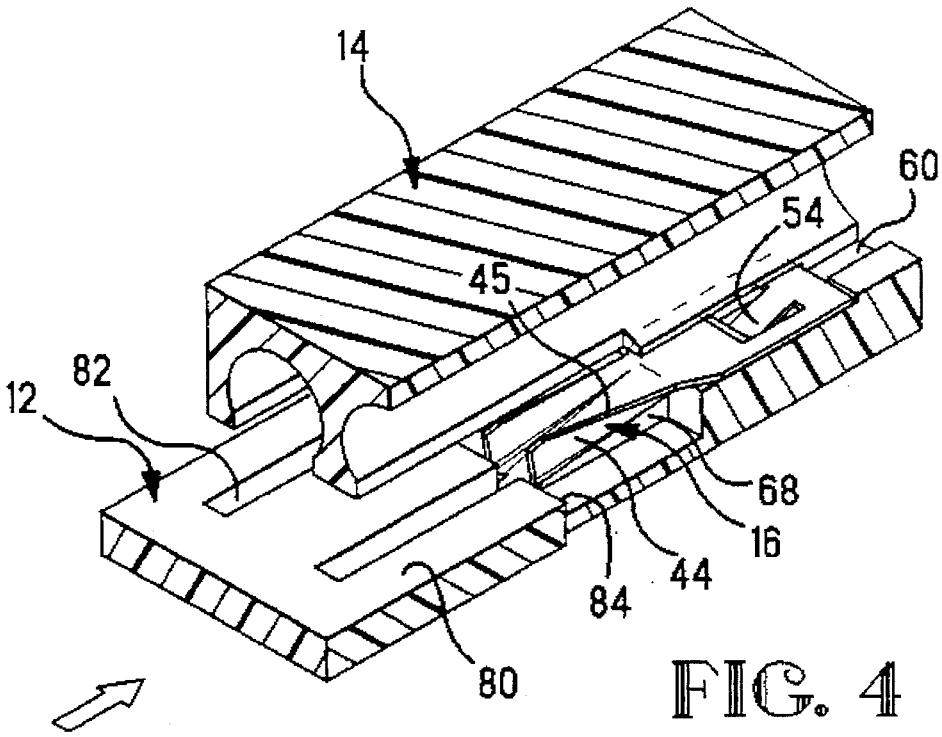
FIG. 4 is a sectional perspective view, similar to that FIG. 3, illustrating the terminal retention member moved to a stressed position, the terminal position assurance member is shown in a partially inserted position.
Figure 6:
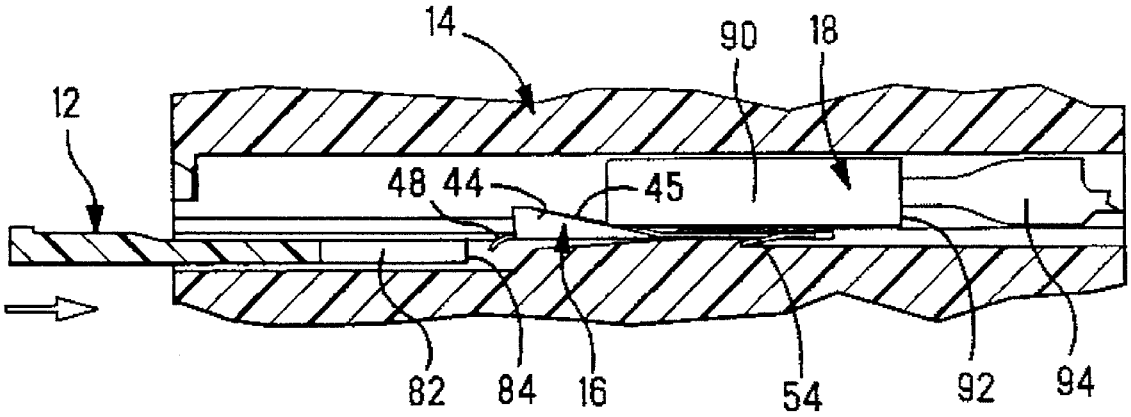
FIG. 6 is a cross-sectional view of a terminal receiving cavity with the terminal partially inserted therein and prior to the deflection of the terminal retention member.

FIG. 4 helps illustrate the movement of the terminal retention member 16 as terminal 18 is inserted into the terminal receiving cavity 24. However, in FIG. 4 the terminal 18 is not shown for purposes of illustration. It is important to note that as the terminal is inserted into the terminal receiving cavity the terminal position assurance member 12 is prevented from being fully inserted into the terminal receiving cavity. The leading surface 84 of the terminal position assurance member 12 engages edges of walls 44 to prevent the terminal position assurance member from being further inserted.

Figure 8:
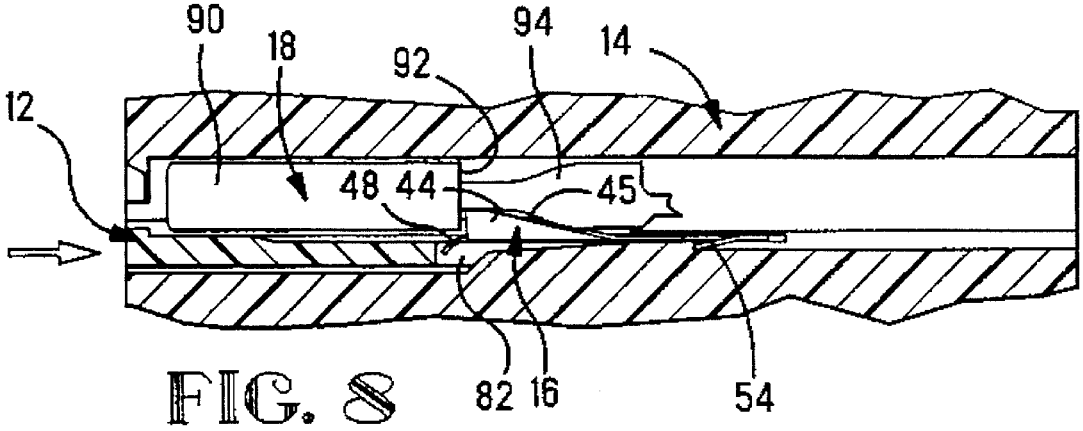
FIG. 8 is a cross-sectional view, similar to that shown in FIG. 6, of the terminal receiving cavity with the terminal fully inserted therein.

Referring to FIG. 8 the terminal 18 is shown in its fully inserted position. In this position, the contact portion 90 of the terminal 18 is moved beyond the terminal locking section 42 of the terminal retention member 18. This allows the terminal locking section 42 to resiliently return to an unstressed position. In this position, the edges of walls 44 cooperate with shoulder 92 of terminal 18 to retain the terminal in the terminal receiving cavity 24. In this position, as illustrated in FIG. 8, the terminal is prevented from forward or reward extraction from the cavity.

Figure 5:
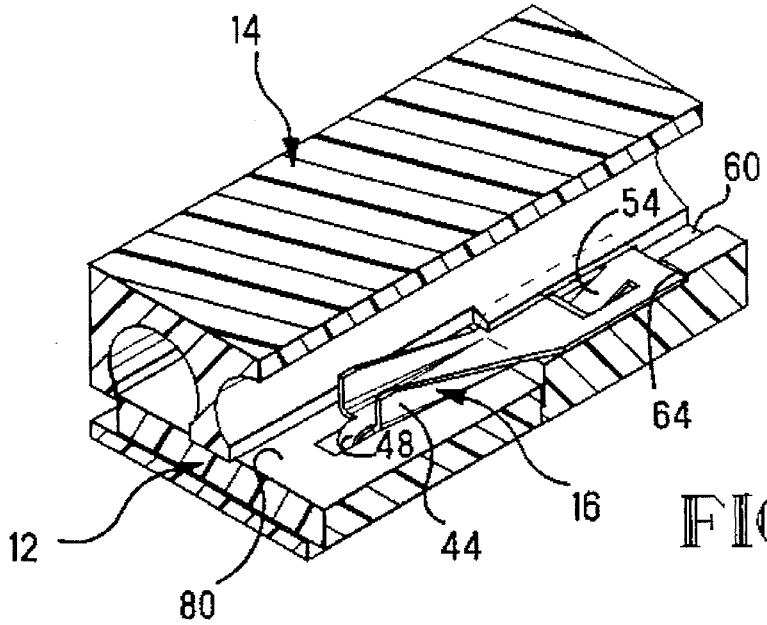
FIG. 5 is a sectional perspective view, similar to that shown in FIG. 3, illustrating the terminal retention member in an unstressed position, the terminal position assurance member is shown in the fully inserted position.

FIG. 5 illustrates the position of the terminal retention member 16 when the terminal is fully inserted (the terminal is not shown for the sake of illustration). In this position the terminal position assurance member may be fully inserted into the terminal receiving cavities. Slot 82 of the terminal position assurance member is in alignment with rib 68 provided in the terminal receiving cavities 24. Slot 82 has a slightly larger dimension than rib 68. Spacer legs 80 are positioned in spacer receiving area 70, as is best illustrated in FIGS. 5 and 8. With the terminal position assurance member 12 fully inserted into the housing 14 the spacer legs 80 cooperate with the base 46 of the terminal retention member 16 to prevent the downward movement of the terminal locking section 42 in the terminal receiving cavity 24. Consequently, as the terminal retention member 16 is prevented from downward movement the terminal 18 is positively secured in the terminal receiving cavity 24.

In the event that one or more terminals are only partially inserted into the cavities, the terminal retention member will not be allowed to move to the unstressed position previously discussed. This prevents the movement of the terminal position assurance member to the final position and thereby alerts the installer that the connector is not fully operational. This visual indication provides a positive means to ensure that all the terminals are seated in the terminal receiving cavities.

Depending upon the space requirements for the particular connector, it is conceivable that the terminal retention members be made of relatively thin metal stock. In such applications it is important that the rib 68 be configured in such a manner so as to prevent the overstress of the terminal locking section 42. As is shown in FIGS. 7 and 4, the rib 68 supports the base 46 of the terminal locking section 42 as a contact in inserted therein. The rib also prevents the overstress of the terminal locking section 42 if the terminal position assurance member 12 is improperly inserted into the terminal receiving cavity 24 prior to the full insertion of the terminal therein. In other words, if the leading edge 84 of the terminal position assurance member 12 engages the edge of the walls 44 as the terminal locking section 42 is in the stressed position, the configuration of the rib 68 will prevent the base 46 of the terminal locking section from deforming in a plastic manner.

Figure 9:
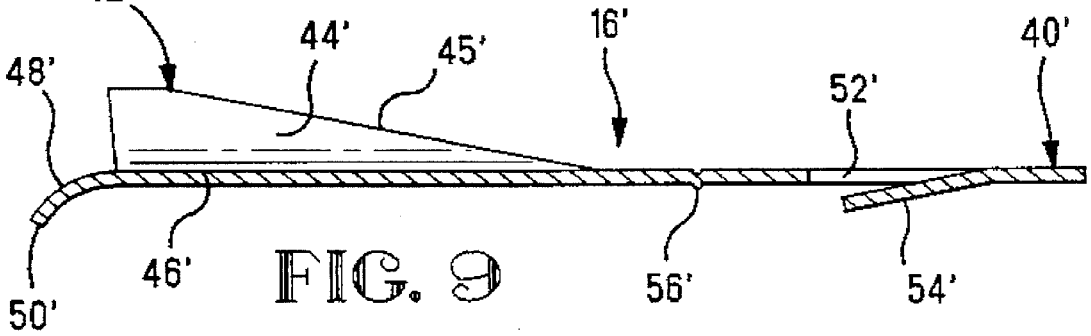
FIG. 9 is a cross-sectional view of an alternate version of the terminal retention member.
Figure 3:
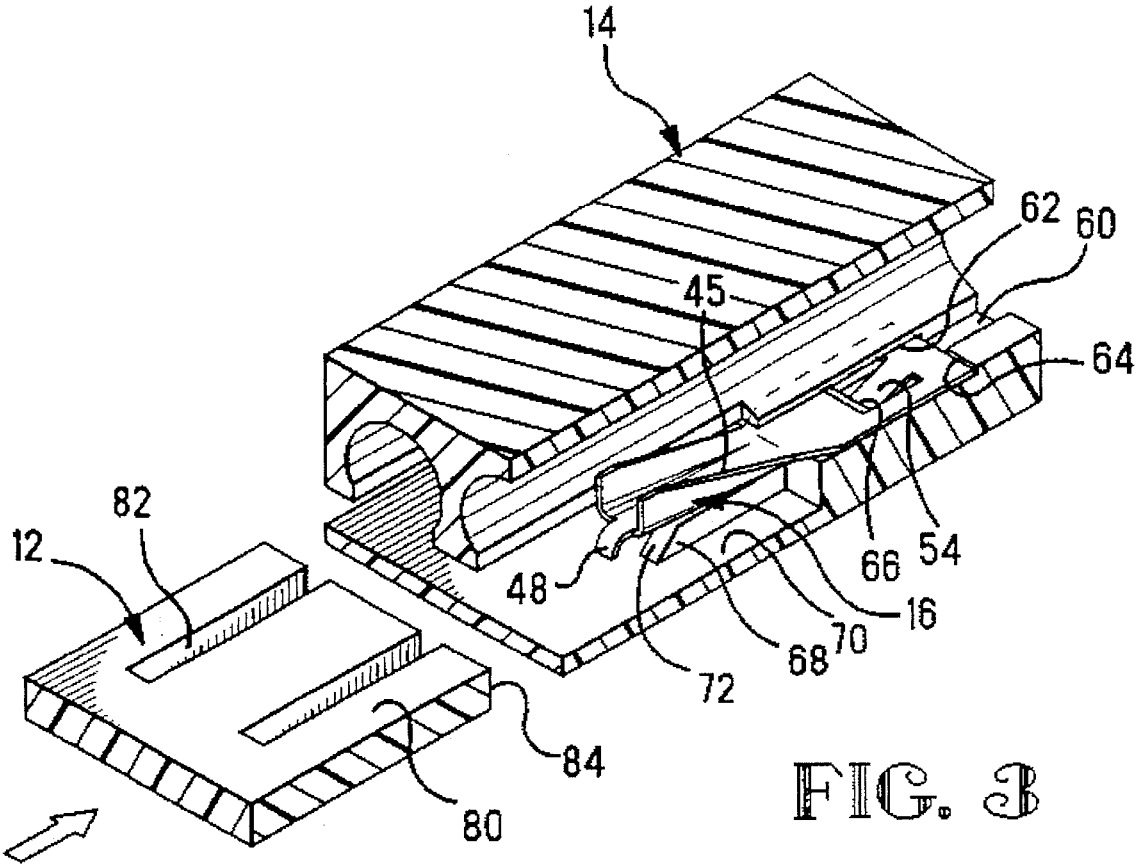
FIG. 3 is a sectional perspective view illustrating the terminal retention member in a terminal receiving cavity prior to insertion of a terminal, a terminal position assurance member is shown in a preinserted position.

FIG. 9 shows an alternate embodiment of the terminal retention member 16'. In this embodiment a dimple or ping 56' is positioned in the transition between the mounting section 40' and terminal locking section 42'. This dimple cooperates with the housing to provide a prestressed position when the terminal retention member is fully inserted into the terminal receiving cavity. The dimple 56' is configured to distribute the forces in such a manner as to help prevent the terminal locking section 42' from taking a permanent set.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

We claim:

1. An electrical connector comprising:

a housing with at least one terminal receiving cavity provided therein, at least one terminal positioned in the at least one terminal receiving cavity, at least one terminal retention member secured in the at least one terminal receiving cavity, the at least one terminal retention member is a separate resilient member which is not integrally molded with the housing, the at least one retention member has a mounting section and a terminal locking section, the mounting section cooperates with the housing to secure the at least one retention member in the least one terminal receiving cavity, the terminal locking section is resiliently deformable and engages the at least one terminal to lock the at least one terminal in the at least one terminal receiving cavity, and a dimple is provided on the at least one terminal retention member, the dimple cooperates with a wall of the at least one terminal receiving cavity to place the terminal locking section in a prestressed position.

2. An electrical connector as recited in claim 1 wherein the terminal locking section has a base and walls extending therefrom, the walls have lead-in surfaces which cooperate with at least one terminal to resiliently deform the terminal locking section as the at least one terminal is inserted into the at least one terminal receiving cavity.

3. An electrical connector as recited in claim 2 wherein the walls of the terminal locking section are perpendicular to the base such that the terminal locking section has a generally U-shaped configuration.

4. An electrical connector as recited in claim 1 wherein an overstress tab projects from the terminal locking section, the overstress tab has a generally arcuate configuration and cooperates with a wall of the at least one terminal receiving cavity to prevent the overstress of the terminal locking section.

5. An electrical connector as recited in claim 1 wherein a locking tab is provided in the mounting section of the at least one terminal retention member, the locking tab cooperates with the housing to maintain the at least one terminal retention member in the at least one terminal receiving cavity.

6. An electrical connector as recited in claim 1 wherein the at least one terminal retention member is stamped and formed from metal.

7. An electrical connector comprising a housing with a terminal receiving cavity provided therein, a terminal positioned in the terminal receiving cavity, a terminal retention member secured in the terminal receiving cavity, the terminal retention member is a separate member which is stamped and formed from metal and is not integrally molded with the housing, the retention member has a mounting section and a terminal locking section, the mounting section cooperates with the housing to secure the retention member in the terminal receiving cavity, the terminal locking section is resiliently deformable and engages the terminal to lock the terminal in the terminal receiving cavity, and an overstress tab projects from the terminal locking section, the overstress tab has a generally arcuate configuration and cooperates with a wall of the terminal receiving cavity to prevent the overstress of the terminal locking section.

8. An electrical connector as recited in claim 7 wherein the terminal locking section has a base and walls extending therefrom, the walls have lead-in surfaces which cooperate with at terminal to resiliently deform the terminal locking section as the terminal is inserted into the terminal receiving cavity.

9. An electrical connector as recited in claim 7 wherein a dimple is provided on the terminal retention member, the dimple cooperates with a wall of the terminal receiving cavity to place the terminal locking section is a prestressed position.

10. An electrical connector comprising:

a housing with a terminal receiving cavity, the terminal receiving cavity has a rib provided therein, a terminal positioned in the terminal receiving cavity, a terminal retention member secured in the terminal receiving cavity proximate the rib, the terminal retention member is a separate resilient member which is not integrally molded with the housing, a terminal locking section of the terminal retention member is positioned proximate the rib such that the rib cooperates with the terminal retention member to prevent the overstress of the terminal retention member.

11. An electrical connector as recited in claim 10 wherein a terminal position assurance member is positioned in the housing, the terminal position assurance member has a slot extending from a leading surface thereof, the slot is aligned with the rib and is dimensioned to be slightly larger than the rib, whereby as the terminal position assurance member is moved to a fully inserted position the ribs are positioned in the slots and spacer legs of the terminal position assurance member cooperate with the terminal locking section of the terminal retention member.

12. An electrical connector as recited in claim 11 wherein the retention member has a mounting section proximate the terminal locking section, the mounting section cooperates with the housing to secure the retention member in the terminal receiving cavity, the terminal locking section is resiliently deformable and engages the terminal to lock the terminal in the terminal receiving cavity.

13. An electrical connector as recited in claim 12 wherein a locking tab is provided in the mounting section of the terminal retention member, the locking tab cooperates with a recess provided in the terminal receiving cavity of the housing to maintain the terminal retention member in the terminal receiving cavity.

14. An electrical connector as recited in claim 13 wherein an overstress tab projects from the terminal locking section, the overstress tab has a generally arcuate configuration and cooperates with a wall of the terminal receiving cavity proximate the rib to prevent the overstress of the terminal locking section.

15. An electrical connector as recited in claim 10 wherein the terminal retention member is formed from metal.

16. An electrical connector as recited in claim 10 wherein a dimple is provided on the terminal retention member, the dimple cooperates with a wall of the terminal receiving cavity to place the terminal locking section in a prestressed position.

* * * * *